United States Patent [19]

Ito et al.

[11] Patent Number: 4,899,140

[45] Date of Patent: Feb. 6, 1990

[54] DISPLAY DEVICE FOR COPYING MACHINES AND THE LIKE

[75] Inventors: Masazumi Ito, Toyohashi; Kadotaro Nishimori, Toyokawa; Masaaki Oyabu, Aichi, all of Japan

[73] Assignee: Minolta Camera Kabushiki Kaisha, Osaka, Japan

[21] Appl. No.: 96,591

[22] Filed: Sep. 11, 1987

[30] Foreign Application Priority Data

Sep. 13, 1986 [JP] Japan ..... 61-216143
Sep. 13, 1986 [JP] Japan ..... 61-216144

[51] Int. Cl.[4] ..... G09G 3/04

[52] U.S. Cl. ..... 340/756; 355/209; 355/308

[58] Field of Search ..... 340/756; 355/14 CU, 355/14 R, 14 C

[56] References Cited

U.S. PATENT DOCUMENTS 4,501,485 2/1985 Tsudaka ..... 355/14 CU
4,614,423 9/1986 Yoshiura ..... 355/14 C
4,619,521 10/1986 Miyamoto ..... 355/14 R
4,629,314 12/1986 Yoshiura et al. ..... 355/14 R
4,647,189 3/1987 Fujiwara et al. ..... 355/14 R

FOREIGN PATENT DOCUMENTS

3315188A1 10/1984 Fed. Rep. of Germany .
3428724 2/1985 Fed. Rep. of Germany .
3428724A1 2/1985 Fed. Rep. of Germany .
57-90653 6/1982 Japan .

*Primary Examiner*—Gerald Brigance
*Assistant Examiner*—Richard Hjerpe
*Attorney, Agent, or Firm*—Price, Gess & Ubell

[57] ABSTRACT

A display device for copying machines and the like and having separate two display sections for displaying conventional numeric information, the two display sections being commonly used for displaying non-constant numeric data. The non-constant numeric data is divided into high-order multiple columns and low-order multiple columns, so that each multiple columns is displayed in a separate displaying section, respectively.

7 Claims, 5 Drawing Sheets

DISPLAY DEVICE FOR COPYING MACHINES AND THE LIKE

FIELD OF THE INVENTION

The present invention relates to a display device for copying machines and the like which is capable of a plurality of displays using a limited number of display elements.

BACKGROUND OF THE INVENTION

Copy machines, printers and the like need to display various kinds of numerical data.

For example, the operation panel of a copying machine is provided with a numeric display section in addition to various keys and indicators. There are conventionally two types of numeric displays: copy number displays used for multi-copies, and copy magnification displays. Copy number displays comprise a two or three column seven-segment display element, while magnification displays comprise a three or four column seven-segment display element.

These copy number and magnification displays are used with every copy option, but a copy machine also requires numeric displays that are used only irregularly. The numerical values displayed in such numeric displays are the total copy number, total copy number for specific paper sizes, and total number of duplex copies and so on. The numeric displays provide information that is necessary for calculating the operating costs and cost-per-copy expenses of the copy machine.

Conventional copy machines provide special displays on the operation panel or in a special portion of the copy machine (an internal section which is visible when the front cover is opened) for displaying these types of information. When such specialized displays are provided on the operation panel, however, the panel area becomes complicated with the result that machine operability is impaired. On the other hand, the provision of a specialized display in an internal portion of the copy machine has the disadvantage of making the displayed values difficult to see.

A display on the operation panel comprising the aforesaid two to four columns has a distinct disadvantage in that it cannot display a total copy number of six digits.

SUMMARY OF THE INVENTION

Accordingly, a main object of the present invention is to provide a display device which is capable of displaying a variety of readily viewable data using a limited number of display elements.

Another object of the present invention is to provide a display device which is capable of using collectively two displays that show specific data in such a way as to display different data.

These and other objects are accomplished by means of a display device comprising two displays for displaying conventional numeric information, and various indicators and the like, which, when displaying non-constant numerical data, divide said data into high-order multiple columns and low-order multiple columns so as to display said numerical data in two display sections.

More precisely, when non-constant numeric data is displayed in the aforesaid display device various indicator displays are switched OFF or the intensity of light emissions from said indicator displays are reduced to enable the non-constant numeric data display to be more readily visible.

Still more precisely, when no other command follows the command to display non-constant numeric data after a fixed period, the aforesaid display device returns the non-constant numeric display to its original mode.

Even more precisely, the aforesaid display device selectively displays a plurality of non-constant numeric data in accordance with the input frequency from a single key-input means.

BRIEF DESCRIPTION OF THE DRAWINGS

These and other objects or features of the present invention will become apparent from the following description of the preferred embodiment(s) thereof taken in conjunction with the accompanying drawings, in which.

In the following description, like parts are designated by like reference numbers throughout the several drawings.

DETAILED DESCRIPTION OF THE PREFERRED EMBODIMENT

A concrete example of the present invention is hereinafter explained with reference to the accompanying drawings.

Figure 1A:
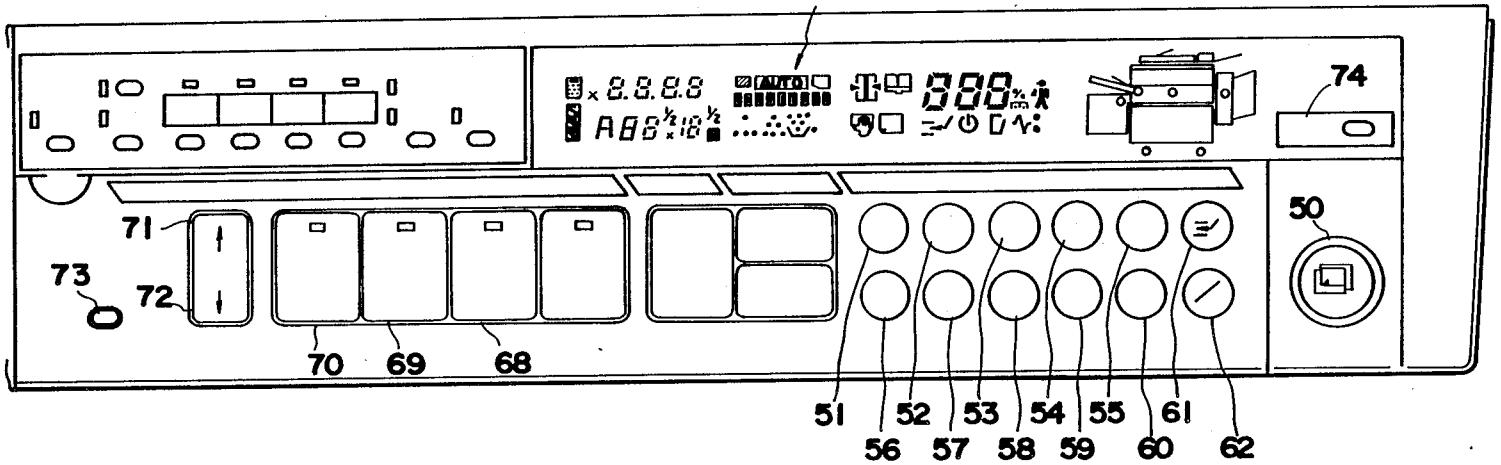
FIG. 1A is a top view of the copy machine operation panel.
Figure 1B:
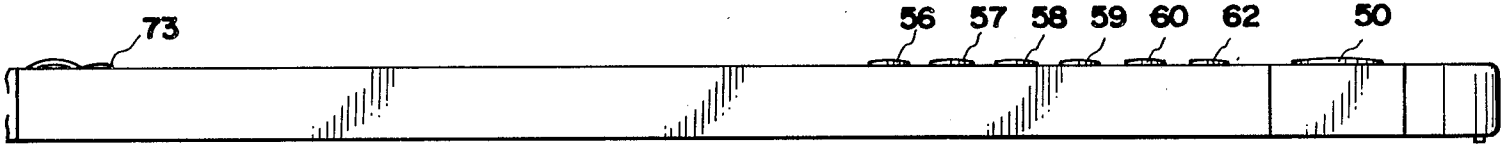
FIG. 1B is a side elevation view of same.

The present embodiment is a single example of the invention applied to the operation panel of a copying machine. FIG. 1A is a top view of the copy machine control panel and FIG. 1B is a side elevation view of said operation panel.

The operation panel has provided thereon various input keys, indicators and displays, as shown in FIG. 1A, i.e., (on the lower right) a printer key 50 for starting the copy process, numeric ten-key array 51 to 60 for setting the copy number and the like, interrupt key 61 for interrupting the copy process, clear/stop (C/S) key for stopping a multi-copy operation and clearing the registered number set via the aforesaid ten keys, set mode reduction keys 68 and 69, set mode magnification key 70, increase-magnification key 71 for increasing copy magnification in graduated units, decrease-magnification key 72 for decreasing copy magnification in graduated units, total check key 73 used to call non-constant numeric data display for displaying the total copy number and the like, (on the upper right side of the control panel) all reset key 74 for initializing the copy mode, and a fluorescent character display section 100 illuminated via a fluorescent character display tube.

Figure 2:
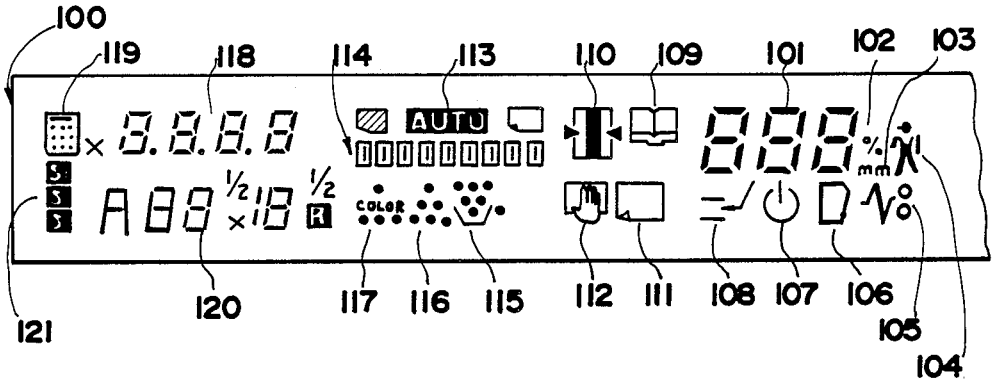
FIG. 2 is an illustration showing all displays and indicators of display section 100 of the operation panel in an ON status.

FIG. 2 is an enlarged diagram of the fluorescent character display section 100. The fluorescent character display section 100 has provided therein, as shown in FIG. 2, a display 101 comprising three sets of seven-segment display elements and having displayed therein a three-column copy number which is set by means of the ten-key array (keys 51 to 60), display 118 comprising four sets of seven-segment display elements and having displayed therein a four-column magnification ratio which is set by means of the magnification setting keys 68 to 72, and other alphanumerical and pictorial displays 102 to 117 and 119 to 121 which each display specific information.

The present embodiment employs display 101 for the aforesaid copy number display and display 118 for the set-magnification display, said displays being rotational displays for showing the several counter values that increment the counts in accordance with the copying operation being performed by the copy machine. These counter values are irregularly viewable data.

The display of the aforesaid counter values is performed by means of depressing the total-check key 73, whereby the counter values are rotationally displayed with each input by said key. As described hereinafter, the non-constant numeric data display is provided with an auto re-set construction, and when the aforesaid counters are displayed in the copy number display 101 and magnification display 118, the other displays (102 to 117 and 119 to 121) in the fluorescent character display section as well as the other indicators on the operation panel have their illumination switched OFF, thus making the numeric displays readily visible, said numeric displays being linked via displays 101 and 118.

Figure 3:
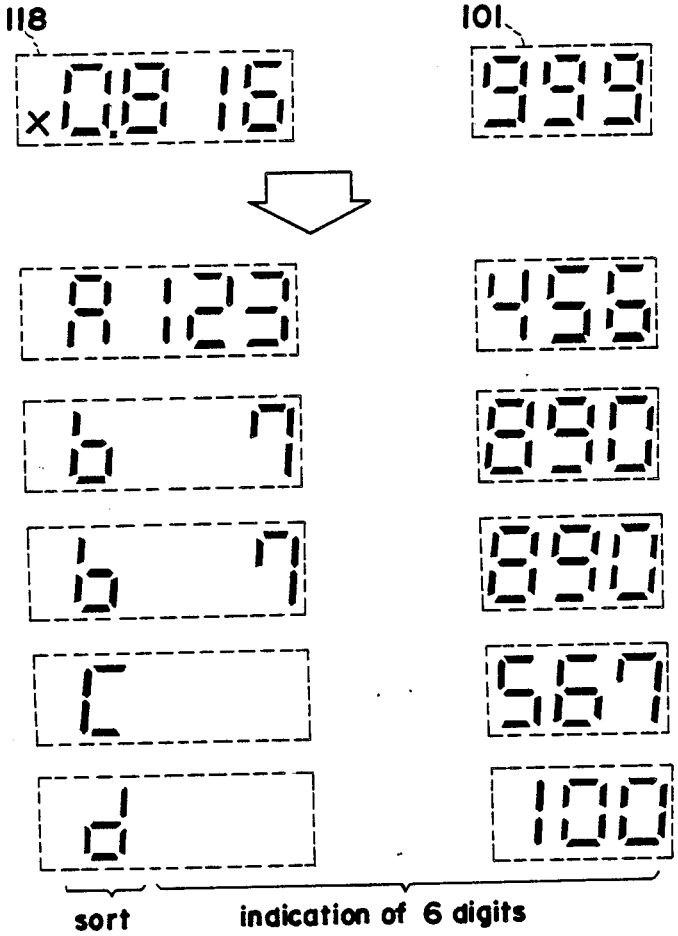
FIG. 3 is an illustrative example to explain the display of a plurality of non-constant numeric data.

FIG. 3 is an explanatory drawing showing a single example of the various counter values displayed in display 101 and display 118. As shown in FIG. 3, letters of the alphabet A, b, C, d are displayed in the first column of the four-column magnification display 118, with one of the types of counter values being clearly displayed therein. Additionally, the three columns of magnification display 118 and the three columns of copy number display 101 are used as a combined six-column display.

Figure 4:
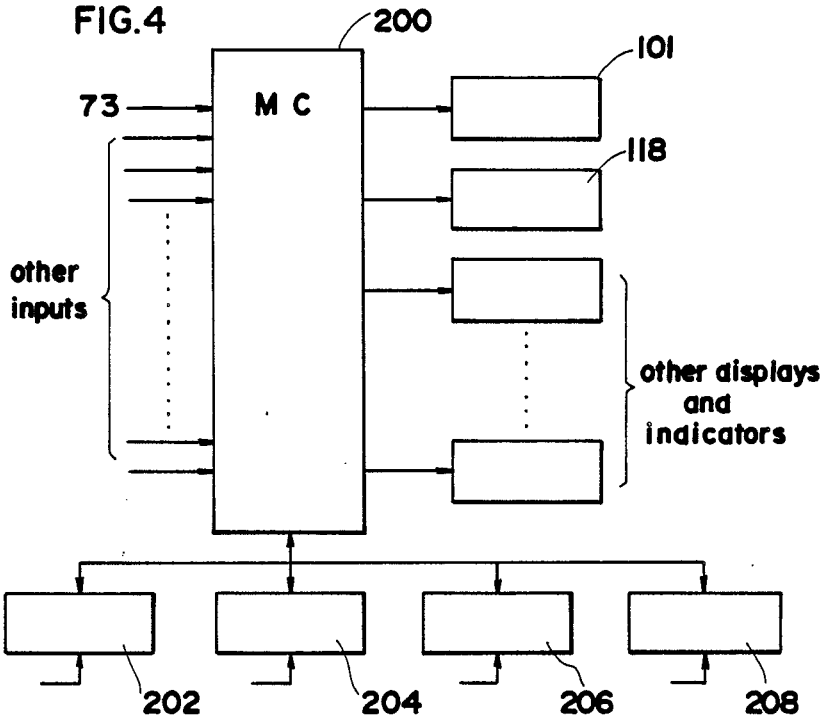
FIG. 4 is an illustrative example showing the circuit construction for controlling the operation panel.

The key input and display from the operation panel are controlled by means of a microcomputer shown in FIG. 4. Microcomputer 200 has connected thereto a total-check key 73 and other keys whereby key input data is received. Then said copy number display 101, magnification display 118, and other alphanumerical and pictorial displays and various indicators are actuated and display information based upon the key input data. Microcomputer 200 has connected thereto counters 202, 204, 206 and 208. Counter 202 counts the total copy number and increments the count with every copy operation. Counter 204 counts the total copy number for a specific paper size, i.e., said counter increments the count for every copy operation involving a specific paper size, for example, A4 paper. Counter 206 counts the total copy number for duplex copies and increments with every duplex copy operation. Counter 208 counts the total duplex copy number for a specific paper size.

Figure 5:
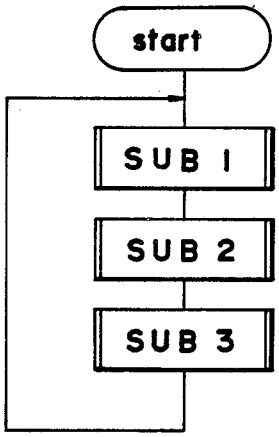
FIGS. 5 and 6 are flow charts showing the microcomputer subroutines for the input illustrated in FIG. 4.

FIG. 5 is a flow chart showing the main routine of microcomputer 200 wherein the hereinafter described counter display processing subroutine SUB 1, counter display mode-clear subroutine SUB 2, and subroutine SUB 3 for other processing are sequentially processed.

Figure 6:
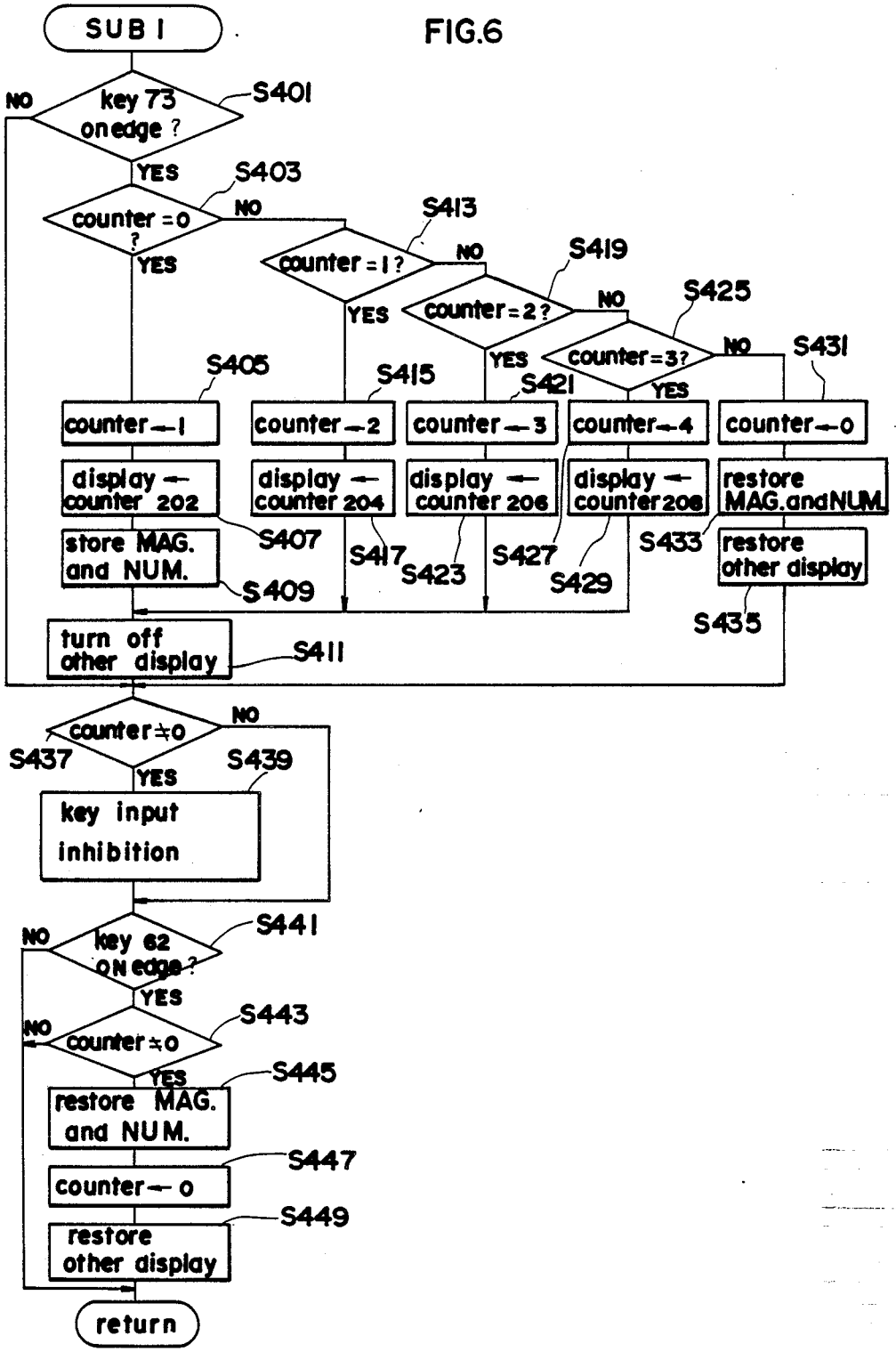
Figure 7:
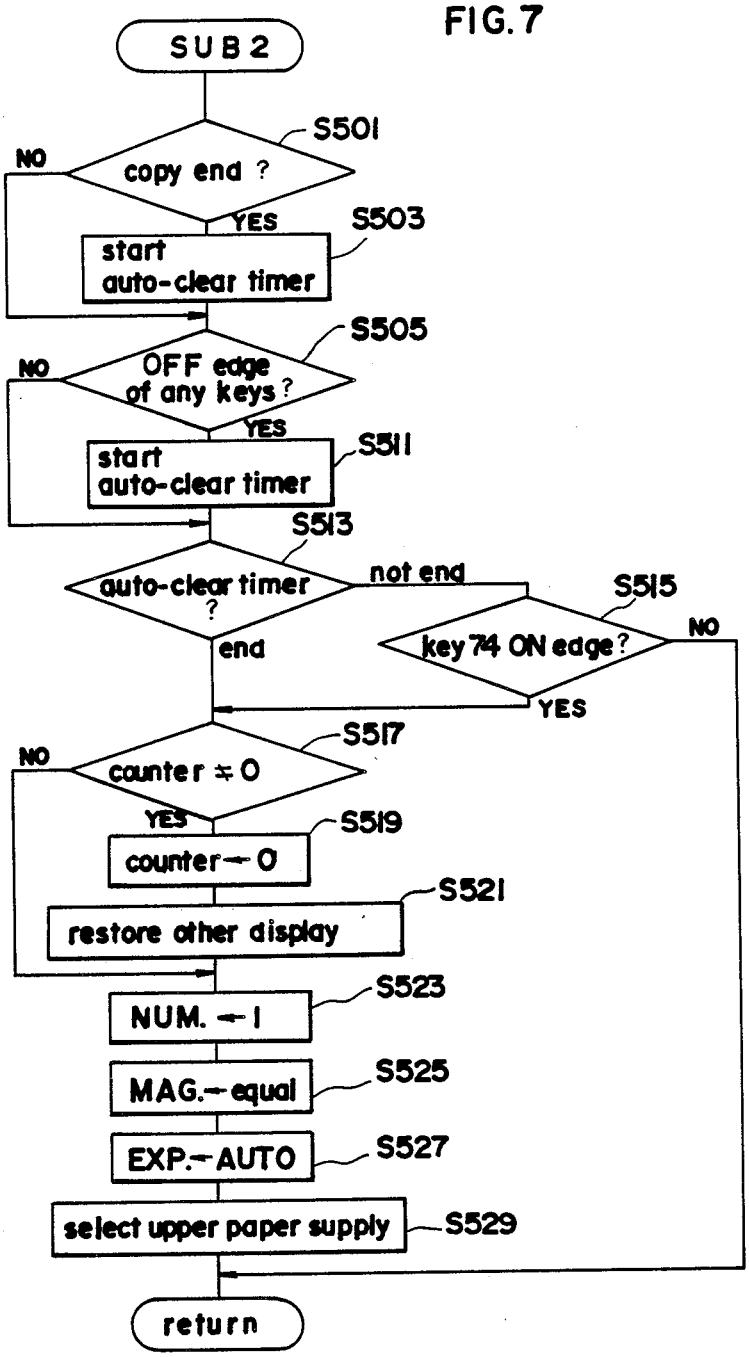
FIG. 7 is a flow chart for counter display processing.

FIG. 6 is a flow chart showing the subroutine SUB 1 for counter display processing. FIG. 7 is a flow chart showing the subroutine SUB 2 for clearing the counter display mode.

Referring to FIG. 6, when the total-check key 73 supplies input (step S401), the display counter code content displayed via 3-bits is checked. The display counter is provided within the RAM of the microcomputer. When the display counter code is "0," magnification display 118 displays the magnification and copy number display 101 displays the copy number. When the display counter code is "1" to "4," each of the various counter values is displayed in displays 118 and 101, e.g., when the counter code is "1," a letter "A" is displayed in the first column and the total counter value indicating the total copy number is displayed in the remaining six columns; when the counter code is "2," a letter "b" is displayed in the first column and the size counter value indicating the copy number for a set paper size is displayed in the the remaining six columns; when the counter code is "3," a letter "C" is displayed in the first column and the duplex counter value indicating the number of duplex copies is displayed in the remaining six columns; when a counter code is "4," a letter "d" is displayed in the first column and the duplex/size counter value indicating the number of duplex copies of a set paper size is displayed in the remaining six columns.

When the display counter code is "0" in step S403, said code is increased to "1" (S405), the total counter value is displayed (S407), the magnification and copy number displayed in the aforesaid displays 118 and 101 is saved in memory (S409), and all other displays on the operation panel other than said displays 118 and 101 are switched OFF (S411) so as to make the total counter value display readily readable. In addition, when the display counter code is not "0" (S403), a check is made to determine whether or not said code is "1" (S413), and if so, said code number is incremented by "1" (S415) and the size counter value is displayed (S417). Thereafter, the display counter code is sequentially checked to determine whether or not it is "2" (S419) or "3" (S425), the counter is incremented in single units (S421 and S427) based upon said determination, and a counter value corresponding to the discriminated codes is displayed (S423 and S429). When the total-check key 73 is depressed (S401) and a counter code other than "3" is indicated (425), the code number is "4" and the code is, therefore, re-set to a value of "0," the copy number and magnification previously stored in the memory are recalled and displayed (S433) and the displays for the other displays on the operation panel are likewise recalled (S435).

Additionally, when the display counter code is not "0" (S437), key entries are prohibited from keys other than the clear key 62, all re-set key 74 and total-check key 73 (S439). When the clear key 62 is depressed (S441), the numeric data display returns to the normal display (S445) even if the various counter numbers are being displayed when said clear key 62 is activated, then the display counter code is set at "0" (S447) and the various displays on the operation panel are recalled (S449).

Referring to FIG. 7, to enable the auto re-set, the autoclear timer count is started (S503 and S511) by means of the copy mode completion timing (S501) or the OFF-edge status of the various keys or switches on the operation panel (S505). Subsequently, when the auto clear timer is expired (513) or the all re-set key 74 is activated (S515), a check is made to determine whether or not the display counter code is "0," and if not, said code is set at "0" and the other displays on the operation panel are recalled (S519 and S521), and each parameter of the copy machine is initialized thereafter (S523 to S529), e.g., the copy number is set at "1" and equal magnification, auto exposure and the top paper inlet are selected. In addition, the same initialization procedure occurs (S521 to S529) even when the display counter code is "0" (S517).

In the aforesaid embodiment the four-column magnification display 118 and the three-column copy number display 101 are combined to form a single display. Thus, a seven column display is possible, said display having a sufficient number of columns wherein to display the various counter values adequately while also indicating the type of display in the first column.

Furthermore, whenever the various counter values are displayed, the illuminated magnification display 118 and copy number display 101 can be observed in a body even though they are used for a fixed interval, said displays being extremely easy to read because the other displays on the operation panel are switched OFF (LEDs OFF, etc.) since they are not required during the copying operation. The inhibition of the other displays may also be accomplished by reducing the intensity of light emissions from the display elements.

Although the display elements used in the aforesaid embodiment are fluorescent display elements, liquid crystal display elements, light emitting diodes, electrochromic display elements and electroluminescent display elements may also be employed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A display device, for use with copying machines, having a first display for displaying a number of copies to be produced, a second display for displaying a magnification ratio to be used for copies and additional indicators provided between the first and second displays, the display device comprising:

means for storing data of a total copy number of copies made on the copying machine, data of the magnification ratio and data of the number of copies to be produced, the data stored in said storing means being applied to said first and second displays;

means for activating the display of the data of the total copy number stored in the storing means;

means, in response to the activating means, for dividing the data of the total copy number into high-order columns and low-order columns so as to display the low-order columns and the high-order columns in the first and second displays respectively, and means, in response to the activating means, for controlling the additional indicators on the display device so as to turn off or reduce the intensity of light emissions of the additional indicators relative to the first and second displays when the means for activating is enabled to inform the operator that a mode of operation showing a total number of copies is being displayed jointly on the first and second displays.

2. A display device as claimed in claim 1 further comprising:

means for returning the first and second displays to display a magnification ratio and a number of copies to be produced in their respective displays after a predetermined time period has elapsed in which no further action from the activating means follows.

3. A display device as claimed in claim 1, wherein the storing means stores a plurality of data as to the total copy number.

4. A display device as claimed in claim 3, wherein the activating means includes a single key and each of the data is displayed sequentially in accordance with an input frequency from the single key.

5. In a display panel for a copying machine having a plurality of visual display members that can be lit for conveying information to a user, at least two of the display members comprise a plurality of display elements for providing multiple digit numerical information including at least a magnification display for providing an indication of magnification and a copy number display for providing a display of a number of copies to be produced, the improvement comprising: means for enabling the magnification display and the copy number display as a unitary display for the display of information relevant to the copying machine operation other than magnification and the number of copies to be produced, and means for visually distinguishing between when the magnification display and the copy number display are used as a unitary display and when said magnification display and said copy number display are not used as a unitary display, such that the unitary display is visually distinguishable from the other visual display members to bring it to the attention of the user only when the magnification display and the copy number display are used as a unitary display.

6. An improved display panel as claimed in claim 5 wherein the means for visually distinguishing includes means for reducing the light emission from the other visual display members to a degree of illumination less than the unitary display while still continuing sufficient light emission to be visible by an operator.

7. A diagnostic display system, for use with copying machines having a compact operator panel with a first light emitting display for displaying a number of copies to be produced, a second light emitting display for displaying a magnification ratio to be used for copies, and additional light emitting indicators provided on the operator panel for conveying other copier operator information to the user, the display system comprising:

first means for storing diagnostic data relating to the use of the copying machine for diagnostic maintenance purposes;

second means for storing data on the magnification ratio and the number of copies to be produced, the data stored in said second means being applied to said first and second light emitting displays;

means for activating the display of the diagnostic data stored in the first storing means;

means, in response to the activating means, for storing any currently displayed magnification ratio and number of copies in the second means;

means, in response to the activating means, for dividing the diagnostic data into a first segment of data and a second segment of data so as to display the first segment and the second segment of data as unitary diagnostic information in the first and second display respectively;

means, in response to the activating means, for causing only the first and second displays, with the unitary diagnostic information, to respectively emit a greater amount of light than each of the additional light emitting indicators to thereby inform the operator, by the difference in the light emission, that a diagnostic mode of operation is being presented by the combined first and second displays, and means for returning the stored data of the number of copies and the magnification ratio from the second means to a display status in the respective first and second light emitting displays after completion of the display of the unitary diagnostic information.

* * * * *